US008378587B2

(12) United States Patent
Huguenin et al.

(10) Patent No.: US 8,378,587 B2
(45) Date of Patent: Feb. 19, 2013

(54) LAMP HAVING SELF-REGULATED LIGHTING

(75) Inventors: Stephane Huguenin, Grenoble (FR); Frederic Piu, Pontcharra (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 172 days.

(21) Appl. No.: 12/936,925

(22) PCT Filed: Apr. 16, 2009

(86) PCT No.: PCT/FR2009/000447

§ 371 (c)(1),
(2), (4) Date: Oct. 8, 2010

(87) PCT Pub. No.: WO2009/133309

PCT Pub. Date: Nov. 5, 2009

(65) Prior Publication Data

US 2011/0031901 A1 Feb. 10, 2011

(30) Foreign Application Priority Data

Apr. 24, 2008 (FR) ..... 08 02233

(51) Int. Cl.
*H05B 37/02* (2006.01)

(52) U.S. Cl. ..... 315/291; 315/307; 315/308; 315/297

(58) Field of Classification Search ..... 315/185 R, 315/209 R, 291, 312, 149–159, 227 R, 231, 315/233, 237, 238, 240, 241 S, 307–308, 315/297; 362/184, 205

See application file for complete search history.

(56) References Cited

U.S. PATENT DOCUMENTS

| | | | |
|---|---|---|---|
| 3,729,262 | A | 4/1973 | Snead et al. |
| 4,546,420 | A | 10/1985 | Wheeler et al. |
| 4,618,254 | A | 10/1986 | Therrien et al. |
| 4,631,675 | A | 12/1986 | Jacobsen et al. |
| 4,896,370 | A | 1/1990 | Kasparian et al. |
| 5,021,645 | A | 6/1991 | Satula et al. |
| 5,701,481 | A | 12/1997 | Hosaka et al. |
| 5,931,562 | A | 8/1999 | Arato |
| 6,095,661 | A | 8/2000 | Lebens et al. |

(Continued)

FOREIGN PATENT DOCUMENTS

| | | |
|---|---|---|
| JP | A 63-046726 | 2/1988 |
| JP | A 7-111193 | 4/1995 |

(Continued)

OTHER PUBLICATIONS

International Search Report issued in corresponding International Application No. PCT/FR2009/000447, mailed Sep. 18, 2009. (with English-language translation).

(Continued)

*Primary Examiner* — Jacob Y Choi
*Assistant Examiner* — Henry Luong
(74) *Attorney, Agent, or Firm* — Oliff & Berridge, PLC

(57) ABSTRACT

A portable electric lamp comprises a lighting module with LEDs and user control means connected to an electronic control circuit to define different lighting modes. An optic sensor is housed in the casing near the light-emitting diode LED to transmit to the control circuit a signal representative of the lighting induced by the lamp to automatically regulate the power of the LED according to a predefined threshold.

7 Claims, 7 Drawing Sheets

U.S. PATENT DOCUMENTS

| | | | | |
|---|---|---|---|---|
| 6,118,415 | A * | 9/2000 | Olson | 345/41 |
| 6,249,089 | B1 | 6/2001 | Bruwer | |
| 7,410,271 | B1 | 8/2008 | Man | |
| 7,495,549 | B2 | 2/2009 | Acres | |
| 7,559,664 | B1 | 7/2009 | Walleman et al. | |
| 2001/0020670 | A1 | 9/2001 | Hyoga | |
| 2003/0020617 | A1 | 1/2003 | Tice et al. | |
| 2004/0036586 | A1 * | 2/2004 | Harooni | 340/435 |
| 2004/0240198 | A1 | 12/2004 | Van Laar et al. | |
| 2005/0099798 | A1 | 5/2005 | Cugini et al. | |
| 2005/0122712 | A1 | 6/2005 | Kim | |
| 2005/0151665 | A1 | 7/2005 | Sommers et al. | |
| 2006/0006821 | A1 | 1/2006 | Singer et al. | |
| 2007/0007898 | A1 * | 1/2007 | Bruning | 315/34 |
| 2007/0133199 | A1 * | 6/2007 | Lebens et al. | 362/157 |
| 2008/0074872 | A1 | 3/2008 | Panotopoulos | |
| 2008/0198586 | A1 * | 8/2008 | Man | 362/157 |
| 2010/0026187 | A1 * | 2/2010 | Kelly et al. | 315/113 |

FOREIGN PATENT DOCUMENTS

| | | |
|---|---|---|
| JP | A 9-048280 | 2/1997 |
| WO | WO 2005/024898 A2 | 3/2005 |
| WO | WO 2006/056066 A1 | 6/2006 |
| WO | WO 2007/060319 A1 | 5/2007 |

OTHER PUBLICATIONS

Patent Office Communication issued in European Patent Application No. 09 738 343.4 dated Sep. 14, 2012.

* cited by examiner

LAMP HAVING SELF-REGULATED LIGHTING

BACKGROUND OF THE INVENTION

The invention relates to a portable electric lamp supplied by a DC power source and comprising a casing containing:

- a lighting module with at least one light-emitting diode LED,
- user control means electrically connected to a first input of an electronic control circuit to define different lighting modes.

STATE OF THE ART

The different functions of a LED lamp controlled by an electronic circuit are conventionally adjustment of the power, of the focusing angle of the beam, of the colour by selecting the LEDs, and of the lighting mode—permanent or blinking. These functions enable the user to adjust his lighting to his environment managing the consumption of electric power supplied by the batteries. Access to one of these functions systematically requires action from the user who has to actuate the manual control means either by pulses (pushbutton), or by pivoting (lever), or by translation (slider).

When the power selected by the user is maximum, sudden movement of the light beam onto a close-by object causes intense lighting which the user's eyes have to get accustomed to. Reciprocally, when the power selected by the user is minimum, sudden movement of the light beam onto a far-away object generates insufficient lighting. Depending on whether the lamp is oriented for close or far vision, this results in a certain visual discomfort, except if the user modifies the state of the manual control means at each movement.

In the document JP9048280, an automatic switch for the interior of a vehicle causes the lamp to light as soon as a hand approaches. According to the document JP7111193, an ambient light sensor actuates lighting of the lamp. Control is performed by servo-controlling the ambient light. In both cases, the sensor does not regulate the light source it senses.

The document JP 63046726 describes a lighting system to regulate illumination of a surface. A sensor is positioned close to the surface, outside the lighting source.

The document WO 2005/024898 relates to a fixed ceiling light with an integrated optic sensor arranged next to the LEDs. The sensor measures the power of the LEDs to control the emitted light according to a setpoint fixed by remote control. Servo-controlling is performed exclusively according to the emitted light. The same is the case for the document US 2008/0074872 which mentions a lighting unit designed to equalize the lighting coming from several lighting modules.

The document US 2007/0133199 relates to a torch light whose lighting is servo-controlled according to various parameters (battery voltage, light emitted).

Object of the Invention

The object of the invention consists in remedying these shortcomings and in providing a portable lamp with regulated lighting enabling the lighting performances to be increased, visual comfort to be procured for the user, and electric power to be saved according to the environment.

The portable lamp according to the invention is characterized in that an optic sensor is housed in the casing near the light-emitting diode LED to deliver a signal representative of the light reflected by the surface of the illuminated object, and to transmit said signal to a second input of the control circuit to automatically regulate the power of the LED according to a predefined threshold.

The optic sensor detects the reflected light and not the emitted light as in the prior art. The light beam emitted by the lamp is thus automatically regulated without any manual action to adjust the lighting to the environment, while at the same time managing the power consumption.

According to a preferred embodiment, the optic sensor is chosen to correspond to the response profile and to the sensitivity of the human eye (passband in the visible comprised between 450 nm and 700 nm), and comprises an optic axis parallel to the longitudinal axis of the lamp. Regulation of the illumination enables the visual comfort to be increased by a sensation of illumination in the longitudinal axis independently from the abrupt change of orientation of the lamp.

Another advantage is to prevent any risk of glare for a group of users each equipped with a lamp according to the invention.

According to a first embodiment, the analog circuit control comprises a comparator circuit having a first input receiving a setpoint corresponding to said threshold, and a second input receiving said signal from the optic sensor. The output of the comparator circuit controls a switch to make resistors in series with the LED vary.

According to a second embodiment, the control circuit comprises a servo-control circuit to adjust the power of the LED by means of a power converter to perform servo-controlling the power of the LED to the first manual setpoint, and to an automatic setpoint coming from the optic sensor and from the current intensity absorbed by the LED. For this purpose, the power converter has a modulation input controlled by:

- a first error circuit receiving the first manual setpoint,
- a second error circuit in connection with the optic sensor whose signal is compared with a second setpoint corresponding to a required lighting level,
- a third error circuit receiving the output signal from the second error circuit and a measurement signal of the current intensity flowing in a resistor in series with the LED, the output of the third error circuit being connected to the first error circuit by means of an amplifier.

According to a third embodiment, the digital control circuit comprises a microcontroller operating according to the following steps:

- activation of the lamp and input of the first setpoint by the user to define the power level or another desired function;
- loading of the power parameters Pmax, Pmin and of the second lighting setpoint;
- acquisition of data from the optic sensor;
- comparison of the data to the threshold fixed by the second setpoint to regulate the power of the LED.

According to a fourth embodiment, the lighting module is composed of two light-emitting diodes supplying a narrow beam and a broad beam. The total power is distributed between the two diodes by a microcontroller associated with three optic sensors, one of which is provided with an optic system only sensing the light emanating from the longitudinal axis of the lamp, the other two sensors sensing the light reflected by the obstacles situated on both sides.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF A PREFERRED EMBODIMENT OF THE INVENTION

Figure 1:
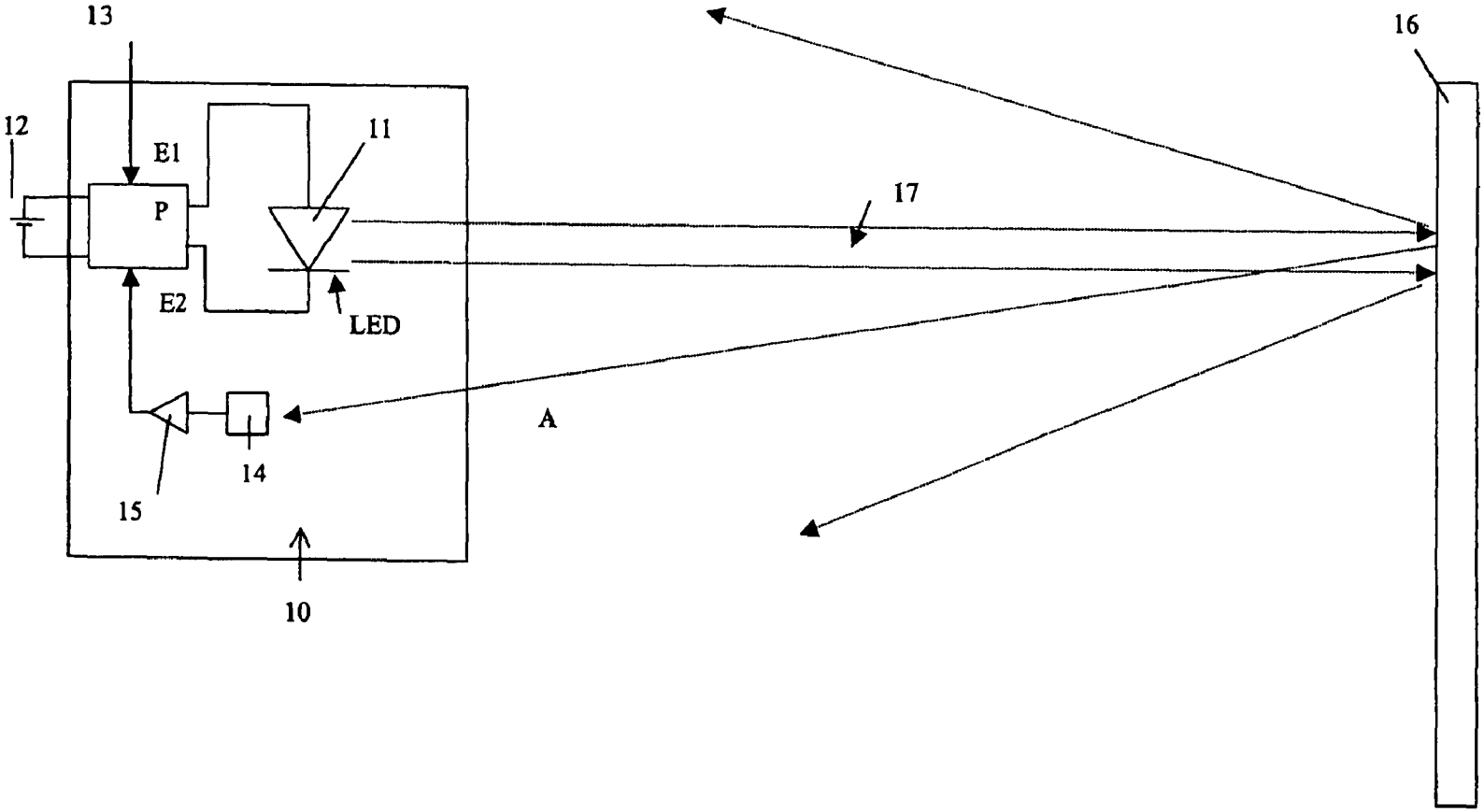
FIG. 1 represents a schematic view of the portable self-regulated lamp according to the invention.
Figure 2:
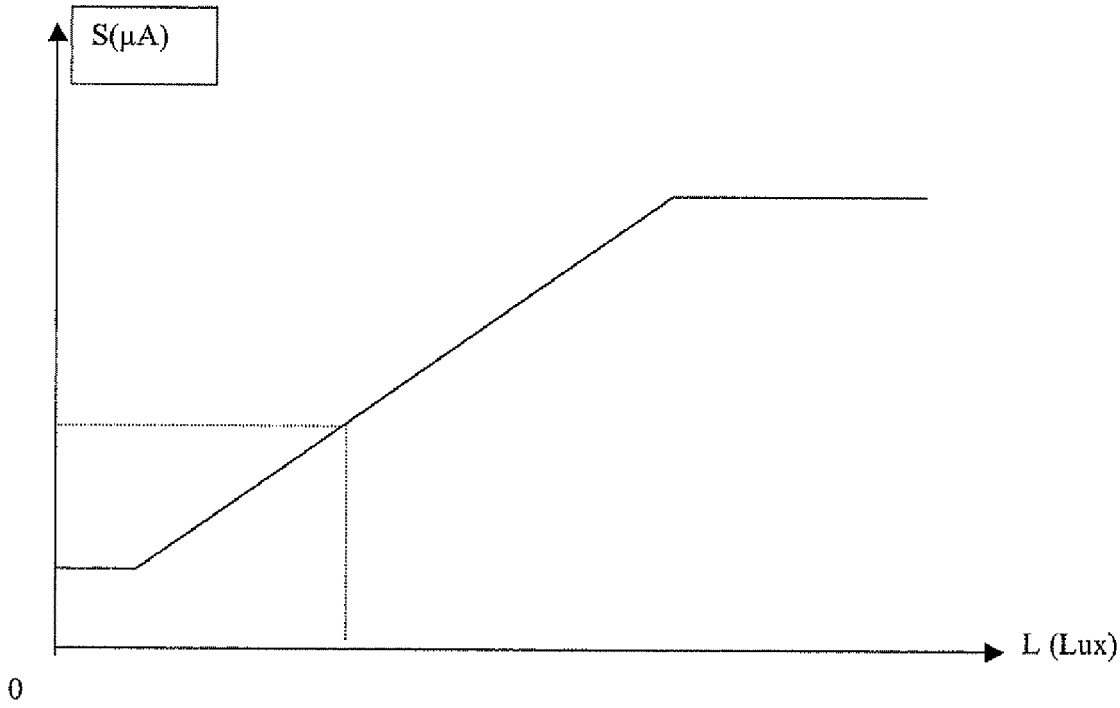
FIG. 2 illustrates a diagram of the signal S (in microA) delivered by the optic sensor versus the received lighting L (in Lux)
Figure 3:
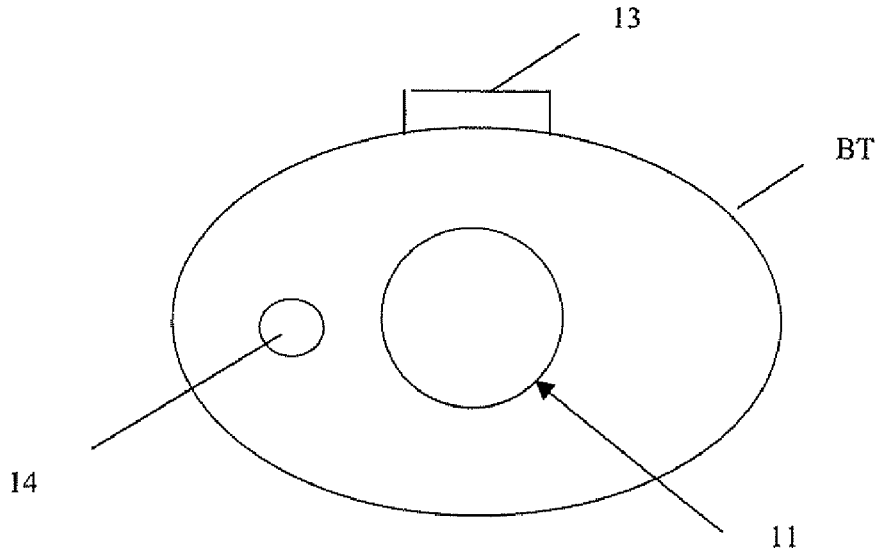
FIG. 3 is a view of the front face of the lamp with the optic sensor and the user control means.

In FIGS. 1 to 3, the electric lamp according to the invention concerns a portable lamp 10 comprising a casing BT housing a lighting module 11 with LEDs arranged on the front face and electrically connected to an electronic control circuit P and to a power source 12. Lighting module 11 can be formed by a single power light-emitting diode LED (case of FIG. 3) or by a series of diodes LED. DC current power source 12 is formed by a rechargeable battery or dry batteries arranged either inside casing BT or outside the lamp in a separate casing. The invention is applicable to a headlamp or to a torchlight with a casing BT made from insulating or metallic material.

A user control means 13 is electrically connected to a first input E1 of control circuit P for switching on or off, and emission of a manual setpoint or input of parameters for choice of the functions of lamp 10.

An optic sensor 14 is housed with lighting module 11 in casing BT of lamp 10. Sensor 14 performs control of the sensed lighting after reflection on object 16 of the light beam emitted by the LED. Sensor 14 is connected via an amplifier 15 to a second input E2 of control circuit P. FIG. 2 is a chart that represents signal S in microA delivered by optic sensor 14 versus lighting L in Lux. The diagram of signal S is a substantially linear function being proportional to sensed lighting L.

Optic sensor 14 is formed by a photosensitive receiver, for example of photodiode, phototransistor, CCD or other type, which is situated close to the LED of lighting module 11. It can be noted in FIG. 1 that rays A reflected by object 16 are sensed directly by optic sensor 14. Output signal S of optic sensor 14 thus represents an image of the illumination of object 16 and of other external light sources. This signal S is interpreted automatically by control circuit P and is used as control input of the functions of lamp 10.

The optic axes of the LED and sensor 14 are preferably substantially parallel so that the image of illumination of object 16 detected by sensor 14 is the most representative. The type of optic sensor 14 is chosen to correspond to the response profile and to the sensitivity of the human eye (pass-band in the visible comprised between 450-700 nm). This results in optimum visual comfort by a sensation of lighting in the axis independent from the visualization movement of the lighted object between two instants (for example map-reading then looking for a waymark located at a distance).

This results in optic sensor 14 detecting the light from the LED of lighting module 11 which it regulates. Light beam 17 emitted by lamp 10 is thus automatically regulated without manual action to adjust the lighting to the environment while at the same time managing the power consumption.

Control circuit P can be achieved in different manners, in particular in the form of an analog or digital electronic circuit, which will be described for exemplary purposes hereafter.

Figure 4:
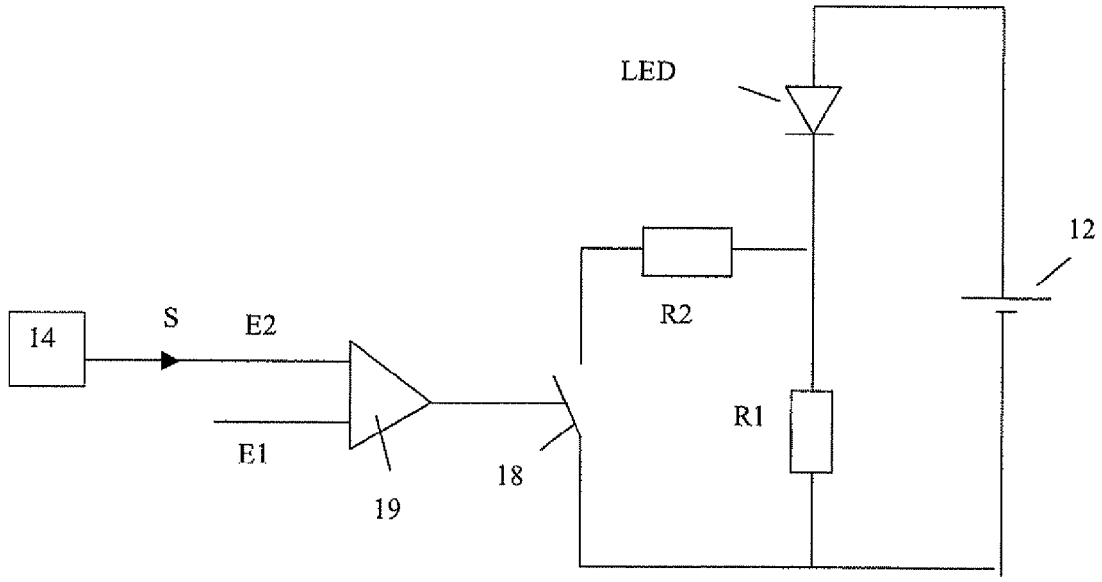
FIG. 4 shows the diagram of an analog control circuit of Schmitt Trigger type.

According to a first embodiment illustrated in FIG. 4, the power of lighting module 11 is determined by a pair of resistors R1, R2 connected with the LED to the terminals of power source 12. First resistor R1 is connected in series with the LED, and second resistor R2 is connected in parallel to the terminals of first resistor R1 by a switch 18 which is controlled by the output of a comparator circuit 19 of Schmitt trigger type with operational amplifier. Control signal S from optic sensor 14 is applied to input E2 of comparator circuit 19. The other input E1 receives a setpoint value corresponding to the threshold of comparator circuit 19.

Depending on whether the value of signal S from sensor 14 is above or below the threshold of comparator circuit 19, switch 18 is open or closed so as to modify the value of the resistance in series with diode LED. This results in a variation of the lighting power of the LED, in particular a maximum power and a reduced power.

Figure 5:
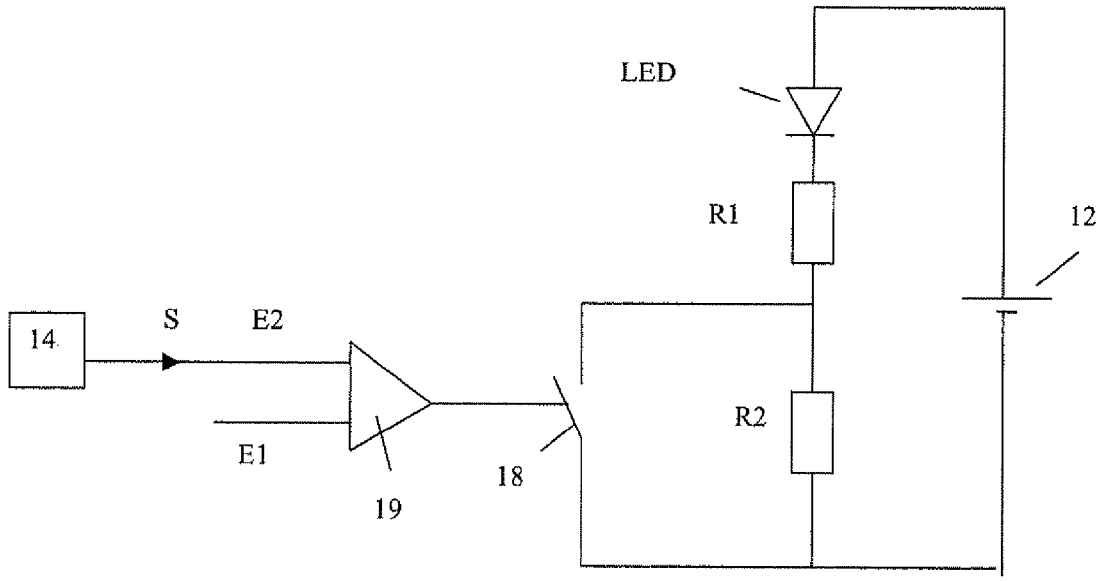
FIG. 5 is a variant of the circuit of FIG. 4.

FIG. 5 is an alternative embodiment of FIG. 4, the two resistors R1 and R2 being connected in series with the LED and switch 18 being able to shunt second resistor R2 according to the state of comparator circuit 19. Operation is similar to that described in the foregoing.

In both cases, we obtain two power levels of the LED automatically regulated by optic sensor 14, which can be suitable for long-distance lighting and short-distance lighting.

Electronic control circuit P can comprise several stages of analog comparator circuits 19 with different thresholds to obtain several power levels of the LED.

Figure 6:
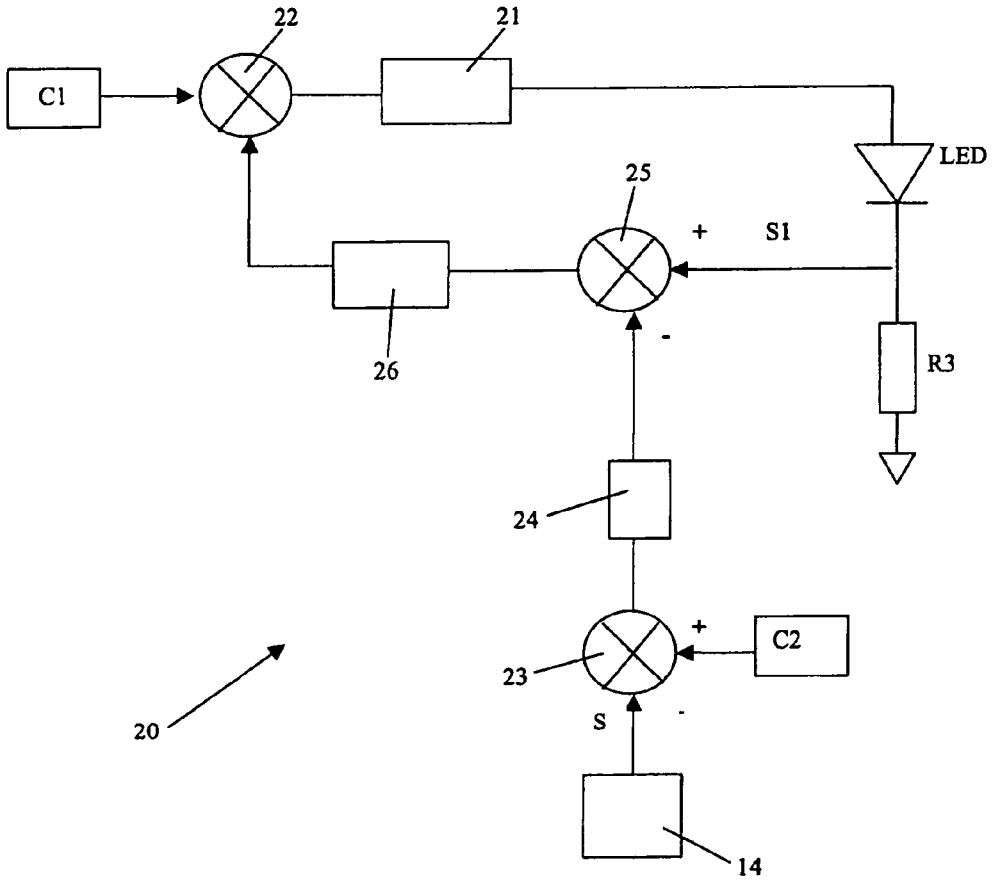
FIG. 6 represents a control circuit to servo-control the power of the LED to the first manual setpoint, and to an automatic setpoint coming from the optic sensor and from the current intensity absorbed by the LED.

The second embodiment of FIG. 6 represents a block diagram of a servo-control circuit 20. The power of the LED is adjusted by a power converter 21 having a modulation input controlled by a first manual setpoint C1 displayed by the user in a first error circuit 22, and an automatic setpoint linked to the response of optic sensor 14. Setpoint C1 can correspond to a certain power level desired by the user. Signal S delivered by sensor 14 is compared in a second error circuit 23 with a second setpoint C2 corresponding to a desired lighting level. The output signal of second error circuit 23 is amplified in an amplifier 24 and applied to a third error circuit 25 which receives a measurement signal S1 of the current intensity flowing in a resistor R3 in series with the LED. The output of third error circuit 25 is connected to first error circuit 22 by means of an amplifier 26. The power of the LED is thus servo-controlled to first manual setpoint C1 and to the automatic setpoint coming from optic sensor 14 and from the current intensity absorbed by the LED. This servo-control circuit 20 makes it possible to keep the illumination of the surface to be observed and to adjust the electric power by regulating the supply current of the LED according to parameters of the environment.

Figure 7:
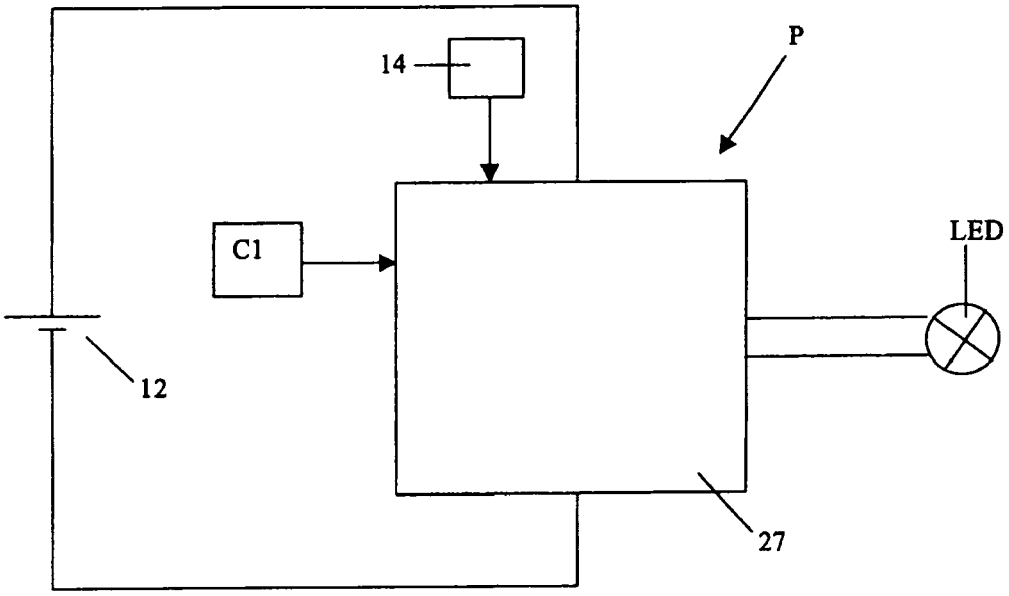
FIG. 7 shows the diagram of a digital control circuit with a micro-controller controlled by the optic sensor and the user control means.
Figure 8:
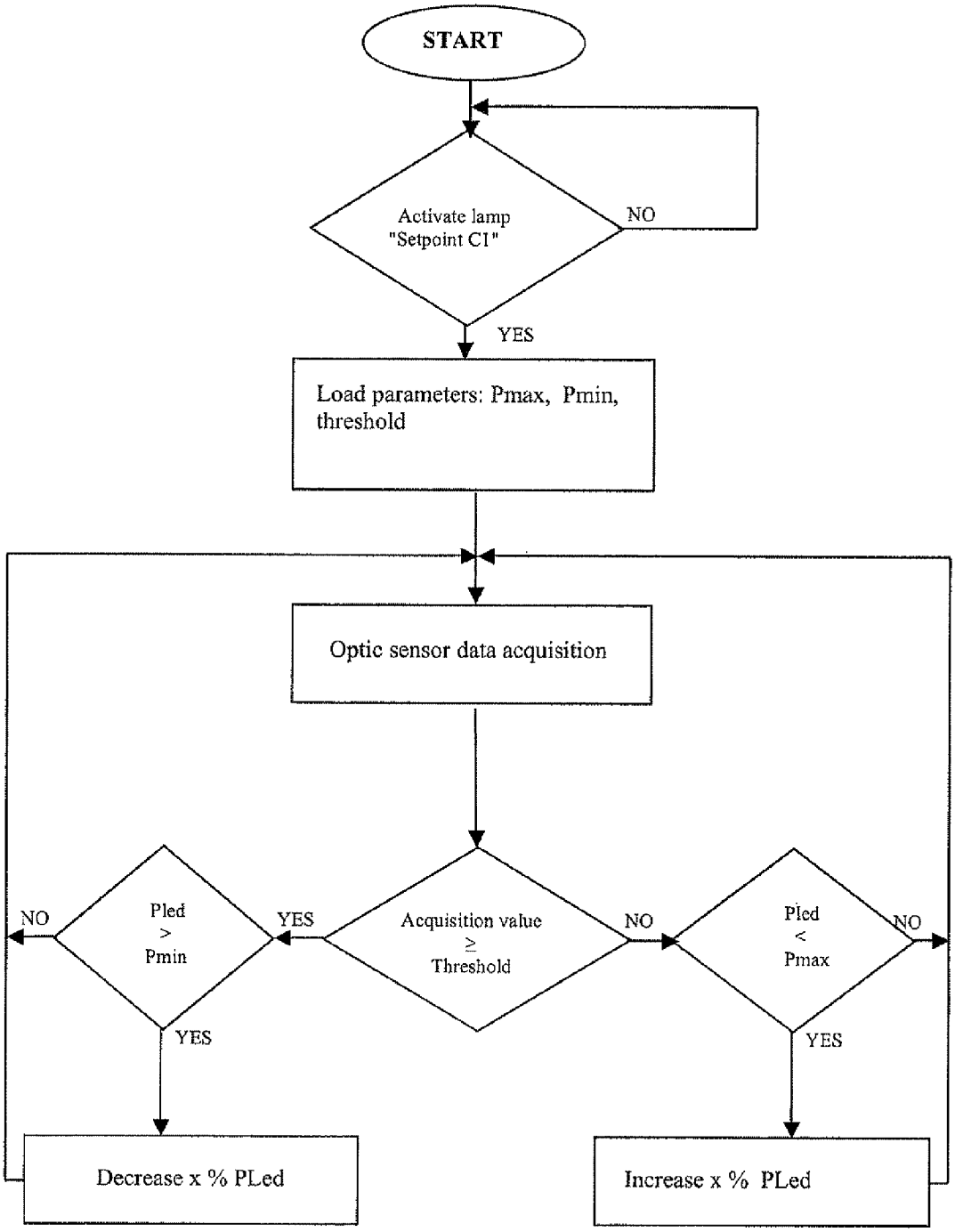
FIG. 8 is the operational flowchart which manages the microcontroller of FIG. 7.

According to a third embodiment represented in FIG. 7, digital control circuit P comprises a microcontroller 27 which controls the power of the LED according to manual setpoint C1 and to the acquisition of optic sensor 14. The flowchart is illustrated in FIG. 8 and comprises the following steps:

activation of lamp 10 and input of first setpoint C1 by the user to define the power level or another desired function;

loading of power parameters Pmax, Pmin and of second lighting setpoint C2;

acquisition of data from optic sensor 14;

comparison of the data with the threshold fixed by second setpoint C2 to regulate the power of the LED.

In a too bright lighting state, the acquisition value from optic sensor 14 is higher than second setpoint C2. If at the same time the power of the LED is greater than Pmin, microcontroller 27 will command a decrease of x% of the power of the LED.

In an insufficient lighting state, the acquisition value from optic sensor 14 is lower than second setpoint C2. If at the same time the power of the LED is lower than Pmax, microcontroller 27 will command an increase of x% of the power of the LED.

The presence of optic sensor 14 enables a constant lighting to be maintained independently from the distance from the lighted object and from the movement necessary for the change of direction. The user's eye does not have to get accustomed as it is the lamp that takes care of this.

Figure 9:
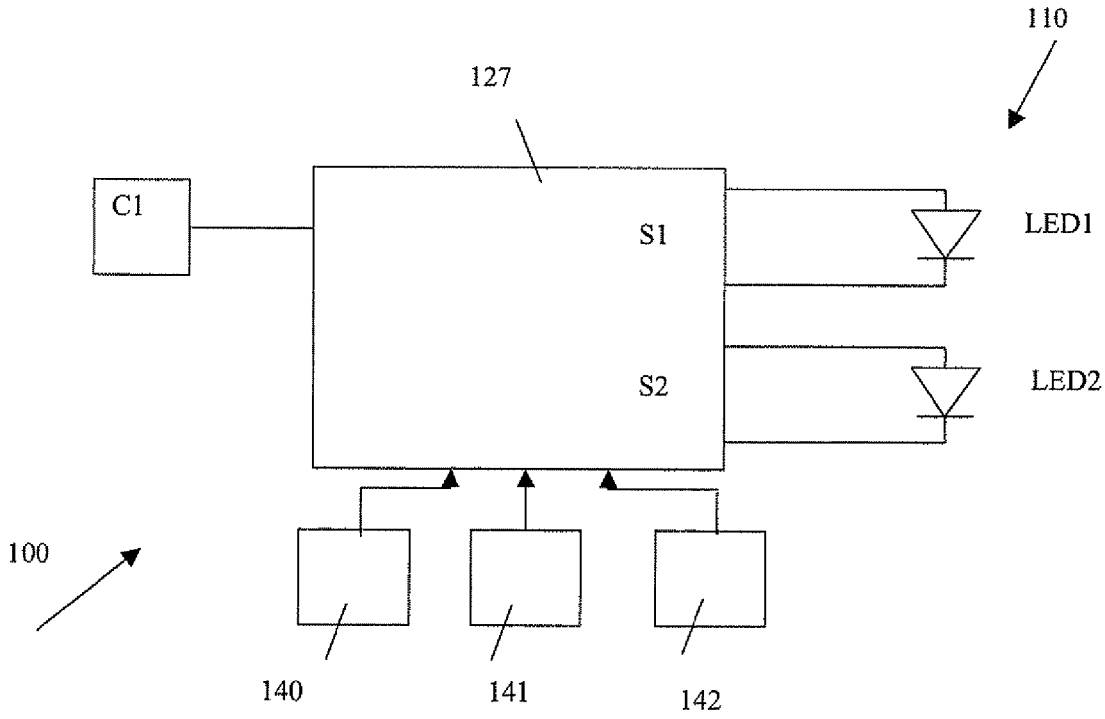
FIG. 9 represents the block diagram of a control circuit with zoom for distribution of the power by means of three optic sensors, one for the front light and the other two for the lights on the left side and the right side.

According to a fourth embodiment of FIG. 9, a variable-focus lamp 100 comprises a lighting module 110 with two light-emitting diodes, LED1, LED2, respectively providing a narrow beam and a broad beam. The total power available is distributed by outputs S1, S2 of microcontroller 127 between the two light-emitting diodes LED1, LED2, according to the principle described in the document WO 2007/060319.

Lamp 100 is equipped with three optic sensors 140, 141, 142, one of which is provided with an optic system only sensing light emanating from the longitudinal axis of the lamp. The other two sensors 141, 142 sense the light reflected by the obstacles situated on both sides. The information delivered by sensors 140, 141, 142 modulates the power distribution between the two leds LED1, LED2 so as to preserve a constant ratio between the light received in the axis and the light received on the two sides, left and right.

The invention claimed is:

1. A portable electric lamp, comprising:

a light-emitting diode, an optic sensor situated near the light-emitting diode and designed to deliver a signal representative of light reflected by an object that is illuminated by the light-emitting diode and that is disposed at a variable distance from the lamp, and a control circuit connected to automatically regulate a power of the light-emitting diode as a function of the signal delivered by the optic sensor, the control circuit including:

a servo-control circuit to adjust the power of the light-emitting diode via a power converter to servo-control the power of the light-emitting diode to a first manual setpoint, and to an automatic setpoint based on the optic sensor and a current intensity absorbed by the light-emitting diode; and a modulation input controlled by:

a first error circuit receiving the first manual setpoint, a second error circuit in connection with the optic sensor, whose signal is compared with a second setpoint corresponding to a desired lighting level, and a third error circuit receiving an output signal of the second error circuit and a measurement signal of the current intensity flowing in a resistor in series with the light-emitting diode, an output of the third error circuit being connected to the first error circuit via an amplifier.

2. The portable electric lamp according to claim 1, wherein the optic sensor comprises an optic axis parallel to the longitudinal axis of the lamp.

3. The portable electric lamp according to claim 1, wherein the optic sensor is chosen to correspond to a response profile and to a sensitivity of human eyes.

4. The portable electric lamp according to claim 1, wherein the control circuit reduces the power of the light-emitting diode upon receipt of a signal from the optic sensor representing a relatively high total amount of light, and the control circuit increases the power of the light-emitting diode upon receipt of a signal from the optic sensor representing a relatively low total amount of light.

5. The portable electric lamp according to claim 1, wherein the control circuit is configured to regulate the power of the light-emitting diode to vary a total amount of light output by the light-emitting diode, a relatively low amount of light being output if the optic sensor sends a signal representing a relatively high total amount of light, a relatively high amount of light being output if the optic sensor sends a signal representing a relatively low total amount of light.

6. The portable electric lamp according to claim 5, wherein the control circuit is configured to regulate the power of the light-emitting diode based on a distance of the object from the light-emitting diode, the control circuit reducing the power of the light- emitting diode if the distance is relatively small, and increasing the power of the light-emitting diode if the distance is relatively large.

7. A portable electric lamp comprising:

two light-emitting diodes configured to respectively provide a narrow beam and a broad beam, three optic sensors situated near the light-emitting diodes and designed to deliver a signal representative of light reflected by an object that is illuminated by the light-emitting diode and that is disposed at a variable distance from the lamp one of the sensors being provided with an optic system configured to sense only light emanating from a longitudinal axis of the lamp, the other two sensors configured to sense light reflected by obstacles situated on both sides of the longitudinal axis, and a control circuit connected to automatically regulate a power of the light-emitting diodes as a function of the signal delivered by the optic sensors, the control circuit including a microcontroller associated with the three optic sensors to distribute total power between the two light-emitting diodes.

* * * * *